US007237365B1

(12) United States Patent
Phandanouvong

(10) Patent No.: US 7,237,365 B1
(45) Date of Patent: Jul. 3, 2007

(54) WOOD SURROUND ALUMINUM COMBINATION STORM WINDOWS

(76) Inventor: Sayavongs Phandanouvong, 2205 Connelly Cir., Burnsville, MN (US) 55337

( * ) Notice: Subject to any disclaimer, the term of this patent is extended or adjusted under 35 U.S.C. 154(b) by 700 days.

(21) Appl. No.: 10/668,069

(22) Filed: Sep. 22, 2003

(51) Int. Cl.
*E06B 7/14* (2006.01)

(52) U.S. Cl. ..... 52/209; 52/204.52; 52/204.593; 52/786.1

(58) Field of Classification Search ..... 52/204.52, 52/209, 204.593, 786.1, 204.61, 204.68; 49/453, 456, 404, 454
See application file for complete search history.

(56) References Cited

U.S. PATENT DOCUMENTS

| | | | | | |
|---|---|---|---|---|---|
| 4,558,536 | A | * | 12/1985 | Dunsmoor | 49/404 |
| 4,566,234 | A | * | 1/1986 | Held | 52/209 |
| 4,837,977 | A | | 6/1989 | Maurp | 49/501 |
| 5,081,793 | A | | 1/1992 | Mauro | 49/501 |
| 5,390,454 | A | * | 2/1995 | Coddens | 52/208 |
| 5,465,539 | A | * | 11/1995 | Rose | 52/204.53 |

OTHER PUBLICATIONS

"Aluminum Storm Windows" published in Review, The Complete Resotration of Historic Windows, from website www.re-view.giz/stormwindows.html, printed Jul. 23, 2003 (2 pages).
"Historic Preservation Commission Guidelines" from www.heritagehillweb.org/hpc_windows.htm, printed Jul. 23, 2003 (7 pages).
U.S. General Services Administration Historic Preservation Technical Procedures from http://w3.gsa.gov/web/p/hptp/nsf printed Jul. 23, 2003 (5 pages).

* cited by examiner

*Primary Examiner*—Carl Friedman
*Assistant Examiner*—Jonathan Junker
(74) *Attorney, Agent, or Firm*—Vidas, Arrett, Steinkraus, P.A.

(57) ABSTRACT

A method of replacing an existing wood window in the framework of a building in order to retain the original wood window appearance is disclosed. A non-wooden double hung window is inserted into a wood frame, including horizontal and vertical members, and a center member, such that the vertical and horizontal members of the non-wooden double hung window along with the non-wooden elements of the upper and lower sash are substantially hidden when viewed from the exterior of the building, thus preserving the original, wood window appearance. The non-wooden double hung window and wood frame combination is fastened to the wood frame and then attached to existing window casings of the building.

4 Claims, 9 Drawing Sheets

2
4
6
8

15
22
20
25
30
35

20
52
45
115
50
55
83
52
22
80
65
7
82
90
70
7
25
8
75
30
100
100
105
8
60
85
95
35
110
97
9

WOOD SURROUND ALUMINUM COMBINATION STORM WINDOWS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to window construction and especially to a window assembly wherein the window has a non-wooden frame assembly. In particular, this invention is directed to non-wooden double hung windows which open and close by vertical movement of the sash.

2. Description of Prior Art

Homeowners or building owners of old or historic properties are faced each summer with the tedious and time-consuming challenge of removing numerous old wood-framed storm windows and replacing each with wood-framed screens to allow airflow. This task is made even worse by the possibility of dropping and breaking the windows. At the end of summer, they must replace the screens with the wood-framed storm windows.

A common issue with renovating windows in older homes or buildings is the desire to preserve the historic, wood appearance of the windows as viewed from the exterior of the house. Namely, the wood-framed storm or screen is flush mounted with the window casing and painted the same color. Many city councils or agencies even require that owners of historic homes or buildings preserve the original appearance of these houses. Owners are therefore confronted with a dilemma: their desire to improve the functionality of the wood-framed window with a modern, energy efficient, low maintenance design, but a need to retain the overall appearance of an all-wood storm window or screen. Modern non-wooden double hung combination storm windows typically consist of an aluminum or vinyl frame. While offering many advantages over all-wood windows in terms of maintenance and insertable screens, modern metal or vinyl windows do not offer the pleasing aesthetics of the historic all-wood windows. Furthermore, it is impractical and costly to paint the metal or vinyl windows to match exterior casings or trim.

Additionally, a common problem exists for the wood frame and non-wood window combination: moisture collecting in the bottom of the window frame.

The U.S. General Services Administration Historic Preservation Technical Procedure, U.S. Pat. Nos. 4,558,536, 4,837,977, and 5,081,793 are of general interest, all of which are incorporated herein by reference in their entireties.

Despite the teachings of the known prior art, there exists a need for preserving the historic appearance of older home and building, while introducing the conveniences of modern window design. What is needed is a combination replacement storm window, which retains the wood appearance of the original wood frame, but combines with it a modern, low maintenance non-wooden double hung window containing moveable sashes and screens from the interior, for easy cleaning, for example.

SUMMARY OF THE INVENTION

While this invention may be embodied in many different forms, there are described in detail herein specific preferred embodiments of the invention. This description is an exemplification of the principles of the invention and is not intended to limit the invention to the particular embodiments illustrated.

In an embodiment of the present invention, a non-wooden double hung window is inserted into a wood frame, including horizontal and vertical members, and a center member, such that the vertical and horizontal members of the non-wooden double hung window along with the non-wooden elements of the upper and lower sash are substantially hidden when viewed from the exterior of the building, thus preserving the original, wood window appearance. The window is fastened to the wood frame and then attached to the building, or existing exterior window or screen hooks can be used. The non-wooden double hung window may be constructed from metal, vinyl, or any of a variety of other non-wooden substances, and includes a screen.

The step of fastening the non-wooden double hung window into the wood frame may include caulk and glue, along with screws or any other method of securing the non-wooden double hung window to the wood frame, including existing exterior hooks.

Another feature of the present invention is the drilling of at least two weep holes in the bottom of the wood frame to allow moisture drainage. This prevents damage to the wood frame caused by draining away moisture that may seep between the wood frame and non-wooden double hung window. The weep holes can be drilled at angle so as to allow drainage from the bottom horizontal member of the wood frame attached to the bottom horizontal member of the non-wooden double hung window to the exterior of the wood frame. Additionally the weep holes can be lined with a water resistant substance, preferably plastic, to prevent the wood interior of the weep holes from contacting the moisture.

The present invention also includes routing at least one groove in the center bar of the wood frame. A non-wood stiffener, preferably aluminum, with at least one protrusion matched to the at least one groove in the center bar may be secured to the center bar to stabilize the frame.

Additionally, the present invention includes routing at least one groove in the bottom horizontal member of the wood frame. A non-wood, preferably aluminum, weather-guard strip with at least one protrusion matched to the at least one groove in the bottom horizontal member may be secured to the bottom horizontal member.

Also, the non-wooden double hung window of the present invention includes a screen in the upper portion, lower portion, or both. Furthermore, another embodiment of the present invention would incorporate a single, full-size screen that covers both the upper and lower portions of the non-wooden double hung window.

BRIEF DESCRIPTION OF THE DRAWINGS

PRIOR ART

PRIOR ART

PRIOR ART

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
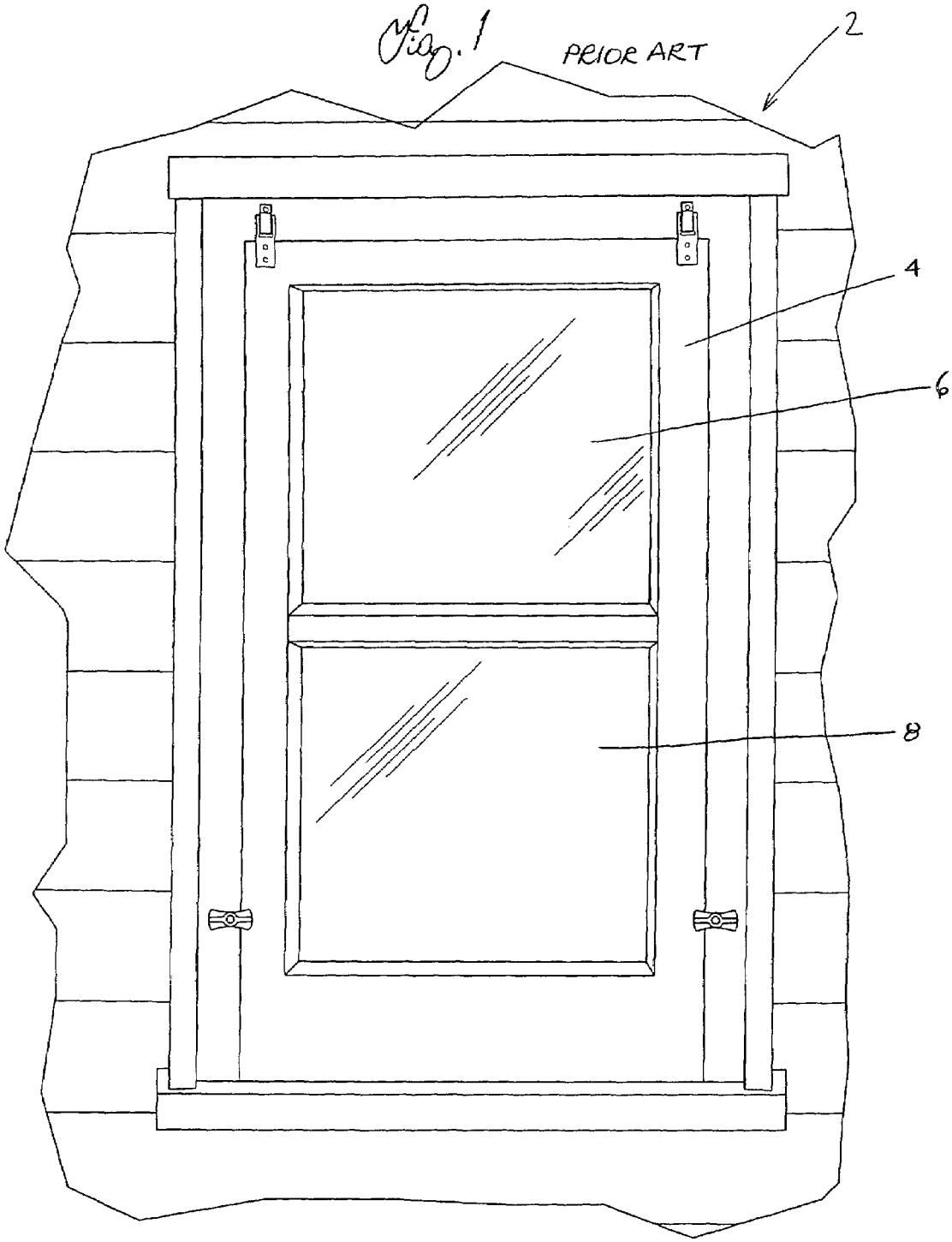
Fig. 1 PRIOR ART
FIG. 1 is a perspective view of a prior art storm window mounted on a common window.
Figure 2:
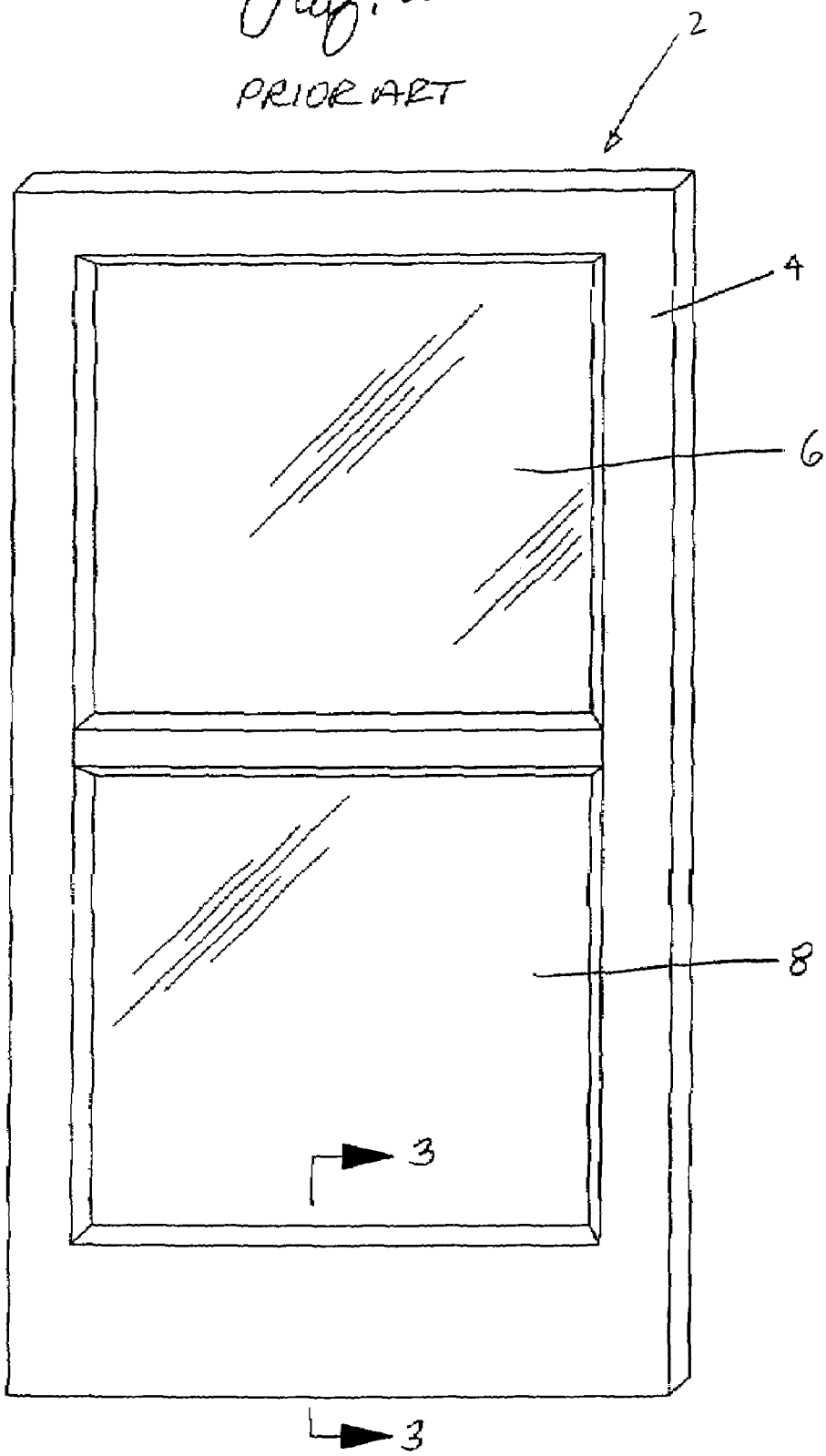
Fig. 2 PRIOR ART
FIG. 2 is a view of the prior art storm window removed from a common window.
Figure 3:
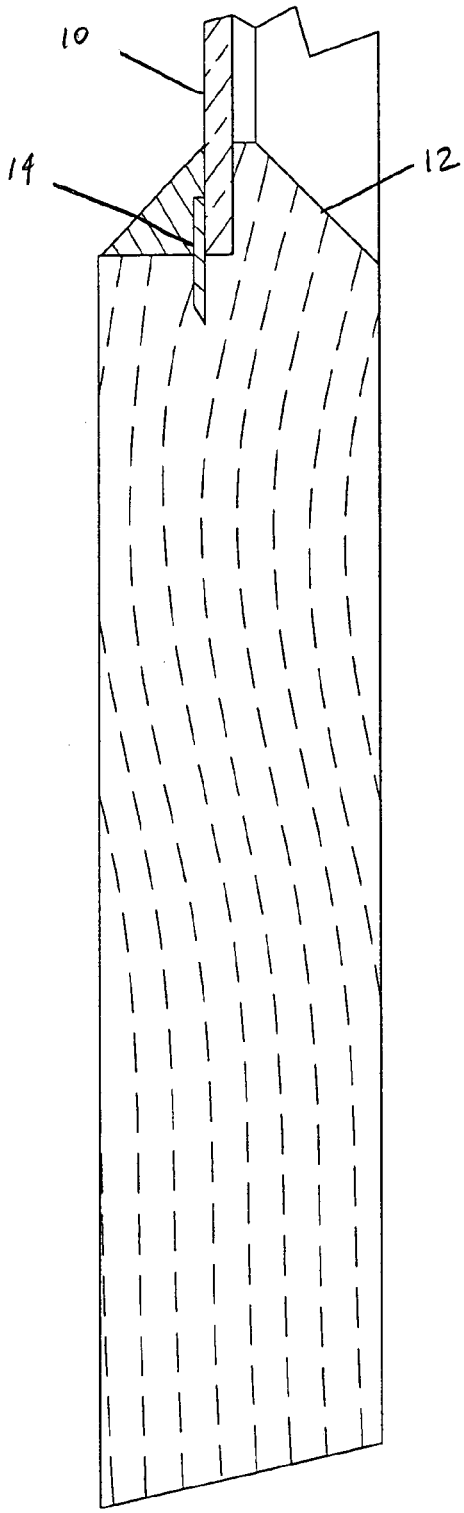
Fig. 3 PRIOR ART
FIG. 3 is a fragmentary sectional detail thereof taken along line 3-3 in FIG. 2.

PRIOR ART FIGS. 1 and 2 show a prior art wood-framed storm window 2 comprising wood frame 4 and upper and lower panes of glass 6 and 8, respectively. The panes of glass are fixed to the frame such that they cannot be moved or adjusted. Not shown is a wood-framed screen that seasonally replaces the wood frame storm window. PRIOR ART FIG. 3 shows a fragmentary sectional detail taken along line 3-3 in PRIOR ART FIG. 2, which includes a glazer's point 14 to secure the pane of glass 10. Also detailed in PRIOR ART FIG. 3 is chamfer 12.

Figure 4:
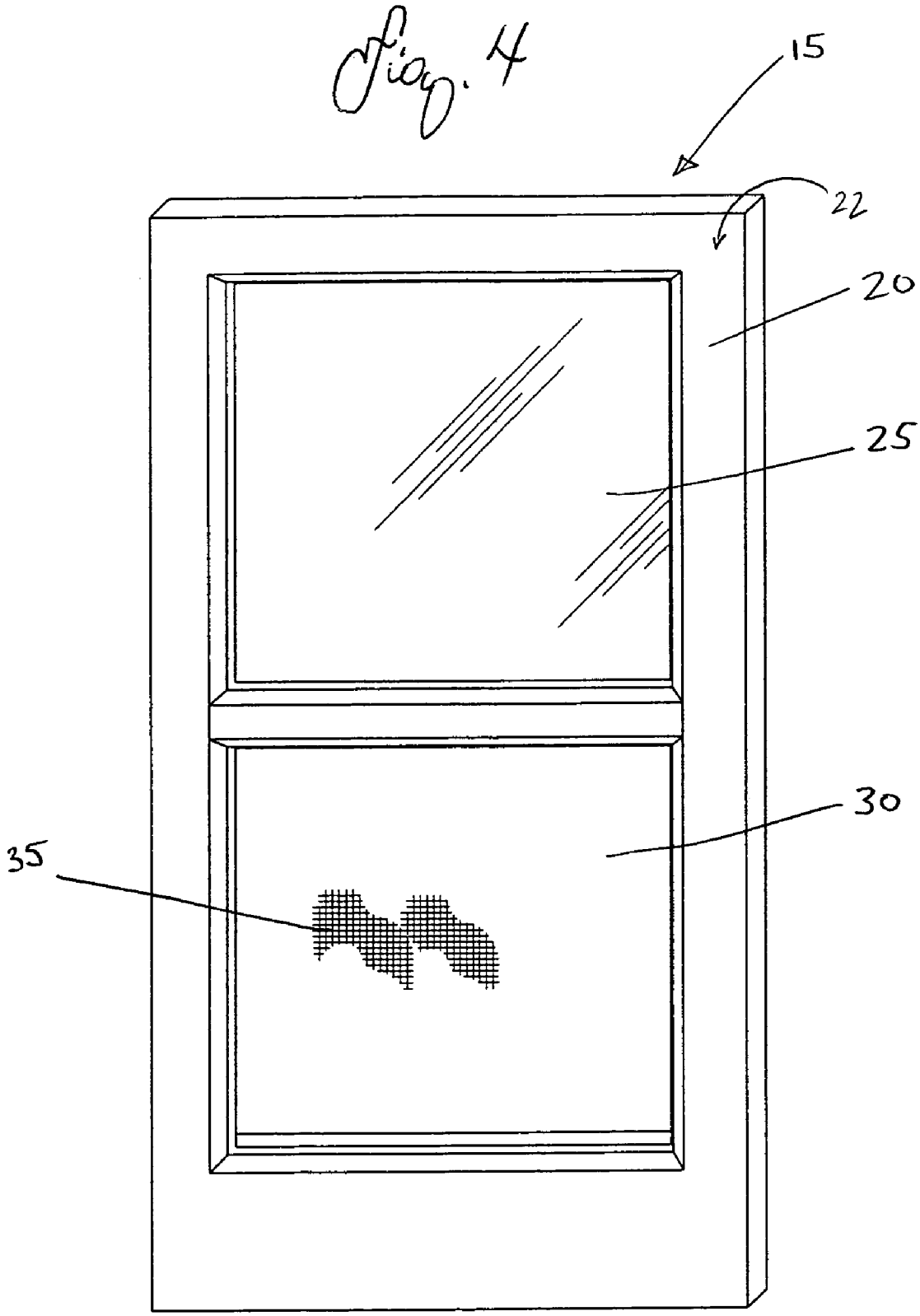
FIG. 4 is a perspective view of the combination window invention shown generally from the front.
Figure 5:
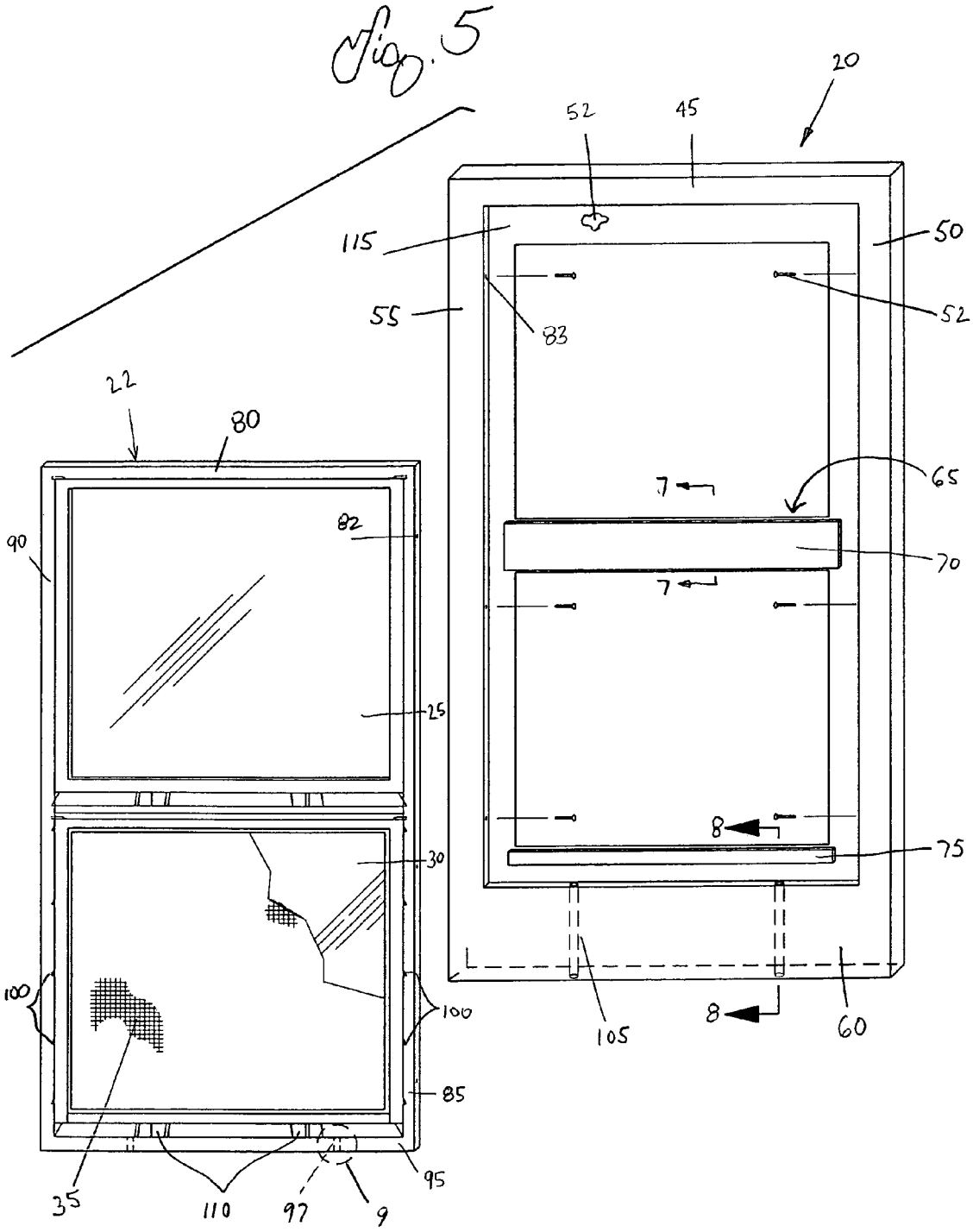
FIG. 5 is a perspective view of the combination window invention assembly exploded from the window frame shown generally from the rear.
Figure 6:
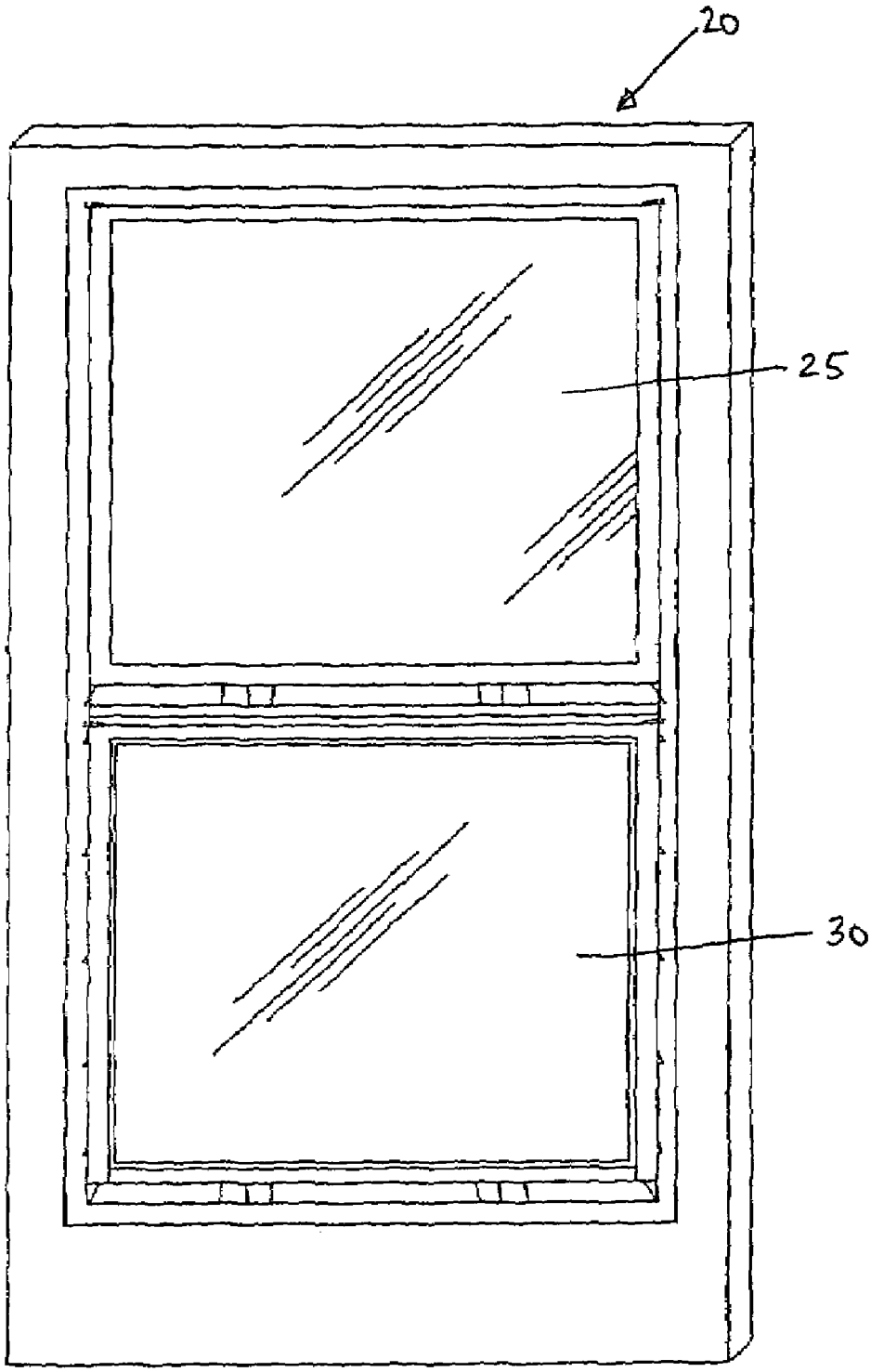
FIG. 6 is a perspective view of the combination window invention shown generally from the rear.

An embodiment of the present invention is illustrated in FIGS. 4, 5, and 6. The purpose of this embodiment is to provide a combination wood frame and non-wood replacement window so that a homeowner or building owner may preserve the historic appearance of a wood window, such as in FIG. 1, while incorporating the convenience of a modern, non-wooden double hung window. As shown in FIG. 4, the new non-wood window 15 comprises a frame 20 and has moveable upper and lower sashes, 25 and 30, respectively. A screen 35 may be fitted into the window, thus eliminating the need to remove the entire window each summer and replacing with a screen. Not shown in the figure are the multiple tracts, well known in the art, which allow the screen and glass to both be installed simultaneously. This is an improvement over the prior art, as an entire wood-framed screen must be used in place of the wood-framed storm window. Furthermore, as can be seen in FIG. 4, the new combination window retains the appearance of the historic window as depicted in FIG. 1.

As can be seen in FIG. 4, the combination of the wood frame 20 and non-wooden double hung window 22, the exterior view of vertical and horizontal members of the non-wooden double hung window are hidden by the vertical and horizontal members of the wood frame, thereby retaining the original wood appearance of the prior art.

Figure 7:
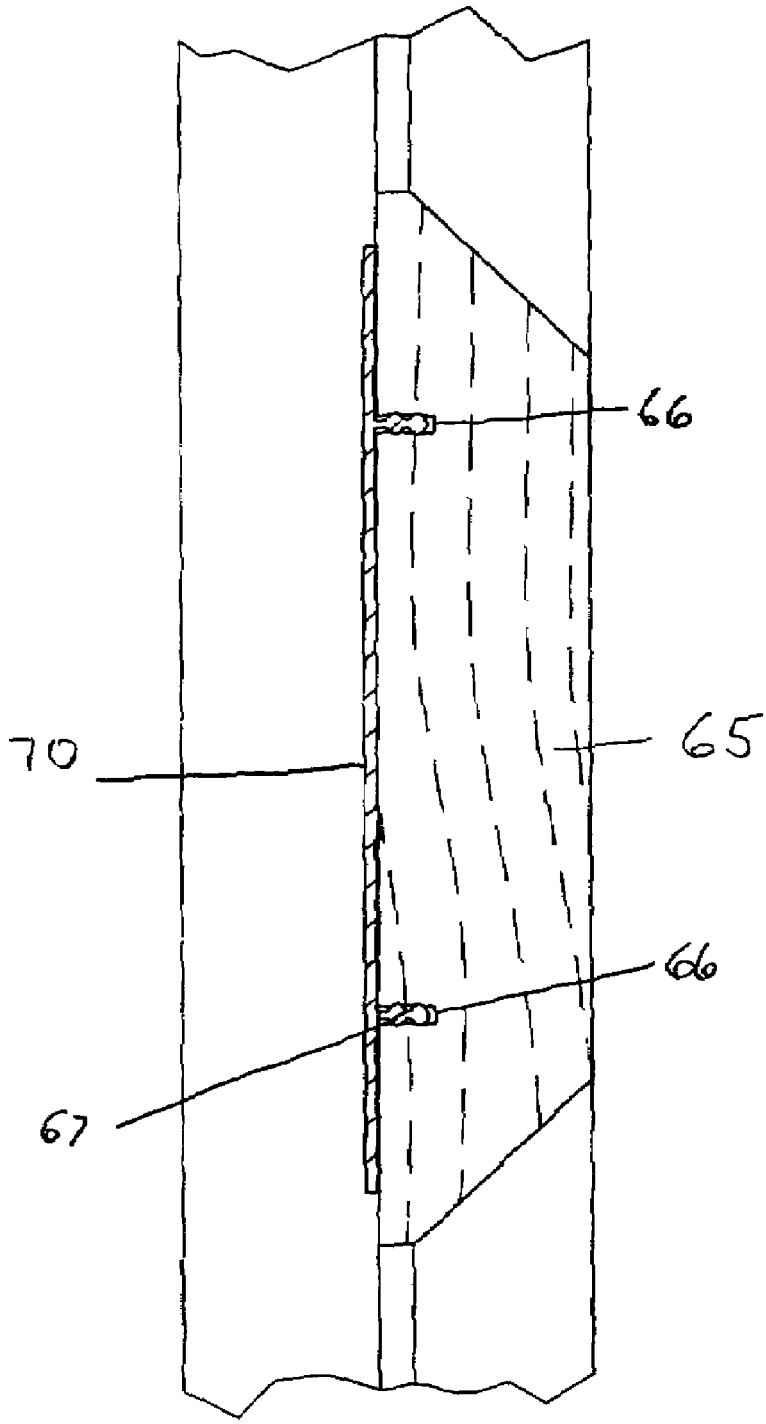
FIG. 7 is a fragmentary sectional detail taken along line 7-7 in FIG. 5.

An embodiment of a wood frame construction is depicted in FIG. 5. FIG. 5 shows a wood frame 20 with a top horizontal member 45 having ends, one end attached to a vertical side member 50, the other end attached to a vertical side member 55. The other ends of vertical side members 50 and 55 are attached to a bottom horizontal member 60. The ends of a center horizontal member 65, shown in detailed cross-section FIG. 7, are attached to vertical side members 50 and 55, approximately equidistant between the top and bottom horizontal members. The center horizontal member 65 includes at least one routed groove 66, also shown in FIG. 7. Stabilization is provided for the wood frame by a center support bar 70 with flange 67, shown in FIG. 7, attached to the center horizontal member 65.

FIG. 5 also shows a non-wooden double hung window 22 including a top horizontal member 80 having ends, one end attached to a vertical side member 85, the other end attached to a vertical side member 90. The other ends of vertical side members 85 and 90 are attached to a bottom horizontal member 95. The non-wooden double hung window is further comprised by upper sash 25 and lower sash 30. The non-wooden double hung window includes multiple tracts as known and previously described (not shown) that provide for a screen 35 to be inserted in addition to the window 30. Also included are detents 100, weep holes 105, further detailed on cross-section FIG. 8, and tabs 110 to locate the sash into the detents. The non-wooden double hung window may be manufactured with or without a variety of typical window features such as tracks, flanges, and locking mechanisms. The flange, if present, may be removed prior to fitting the non-wooden double hung window into the routed area 115 of the wood-framed construction 20.

FIG. 5 shows weep holes 105 drilled into the bottom horizontal member 60 to allow drainage of any moisture that has collected between the wood frame and the non-wooden double hung window. The weep holes should be drilled at an angle such that they drain moisture toward the bottom exterior of the wood frame. Also, the weep holes can be lined with a water resistant substance, such as plastic, to prevent damage to the wood.

Caulk, glue, or any other adhesive 52 of FIG. 5, can be applied to the interior routed surface 115 of the wood frame in FIG. 5 and then the non-wooden double hung window can be inserted into the wood frame. Screws 52, or any other type of connector, can secure the non-wooden double hung window to the wood frame through the non-wooded double hung window screw holes 82 and wood frame screw holes 83 in FIG. 5.

FIG. 6 shows the assembled wood frame, non-wooden double hung window combination as viewed from the rear.

Figure 8:
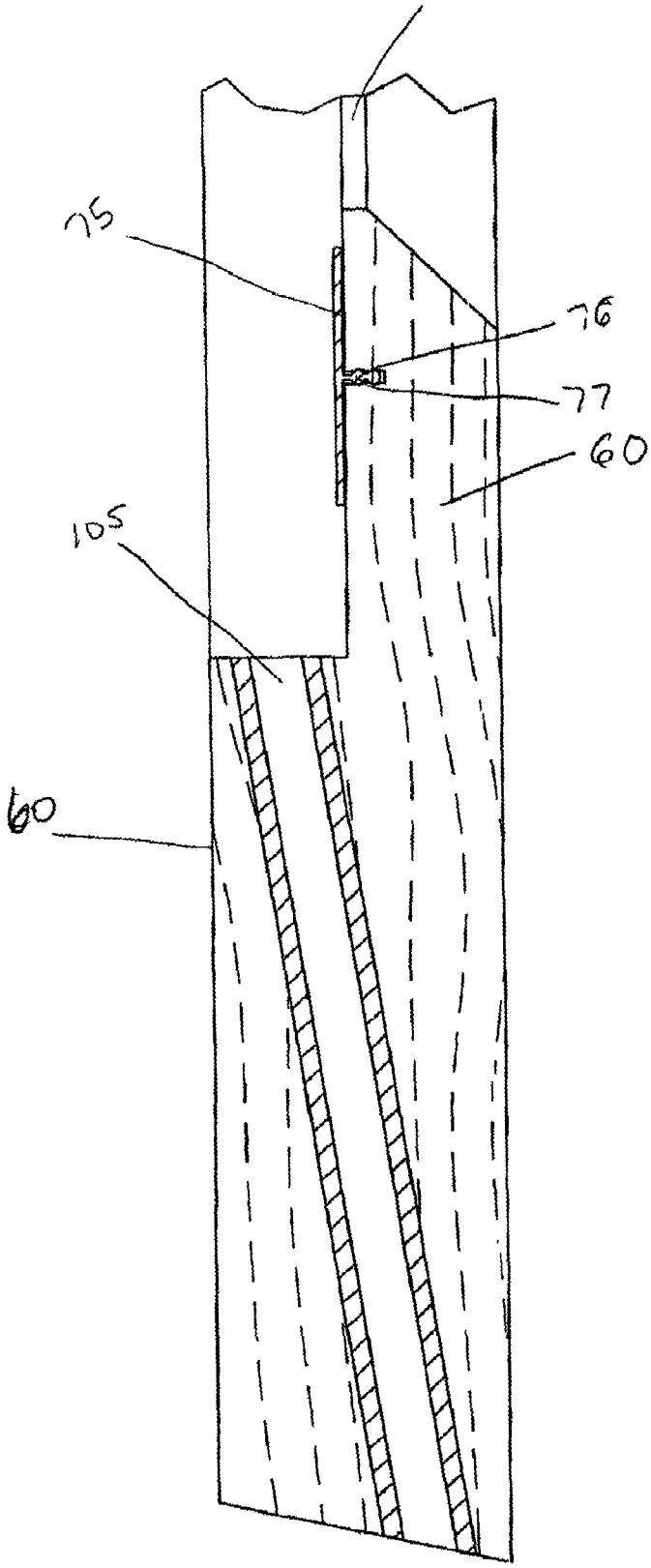
FIG. 8 is a fragmentary sectional detail taken along line 8-8 in FIG. 5.

FIG. 8 shows at least one groove 76 is routed into the bottom horizontal member 60 to allow a weatherguard strip 75 with flange 77 to attach to the bottom horizontal member. This weatherguard strip will protect the bottom horizontal member from moisture that may accumulate between the non-wooden double hung window and the wood frame.

Figure 9:
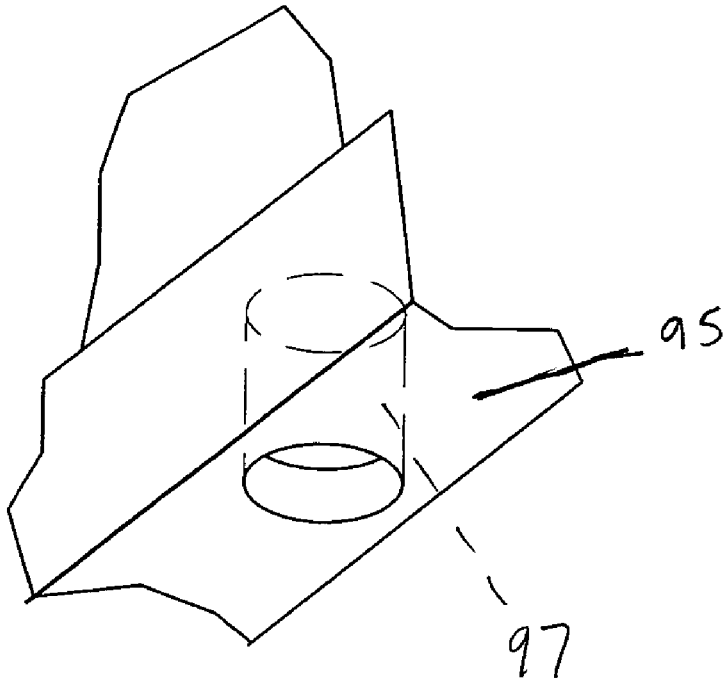
FIG. 9 is a fragmentary perspective view taken from the area encircled at 9 in FIG. 5.

FIG. 9 shows a fragmentary perspective view taken from the area encircled at 9 in FIG. 5.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A method of replacing an existing wood window in the framework of a building to retain the original wood window appearance, comprising the steps of:

providing a replacement wood frame which has a similar exterior appearance to the existing window, the wood frame comprising:

a top horizontal member having ends, each end of the top horizontal member attached to a vertical side member, a bottom horizontal member having ends, each end of the bottom horizontal member attached to the vertical side members so as to construct a substantially rectangular frame with an interior surface and an exterior surface, and a center horizontal member attached between the two vertical members approximately equidistant between the top and bottom horizontal members;

routing at least one groove in the center bar of the wood frame;

adhering a stiffener with at least one protrusion matched to the at least one groove;

inserting a non-wooden double hung window into the wood frame, the non-wooden double hung window comprising:

a top horizontal member having ends, each end of the top horizontal member attached to a vertical side member, a bottom horizontal member having ends, each end of the bottom horizontal member attached to the vertical side members so as to construct a substantially rectangular frame with an interior surface and an exterior surface, and an upper and lower metal window sash;

fastening the non-wooden double hung window to the wood frame; and attaching the wood frame and non-wooden double hung window combination to the framework of the building.

2. The method of claim 1, wherein the stiffener is a non-wood substance comprising aluminum.

3. A method of replacing an existing wood window in the framework of a building to retain the original wood window appearance, comprising the steps of:

providing a replacement wood frame which has a similar exterior appearance to the existing window, the wood frame comprising:

a top horizontal member having ends, each end of the top horizontal member attached to a vertical side member, a bottom horizontal member having ends, each end of the bottom horizontal member attached to the vertical side members so as to construct a substantially rectangular frame with an interior surface and an exterior surface, and a center horizontal member attached between the two vertical members approximately equidistant between the top and bottom horizontal members;

a plurality of weep holes drilled in the bottom of the wood frame, the weep holes drilled at an angle;

at least one groove routed in the center bar of the wood frame;

a stiffener with at least one protrusion matched to the at least one groove adhered to the center horizontal member;

at least one groove routed in the bottom horizontal member of the wood frame;

a weatherguard strip with at least one protrusion matched to the at least one groove adhered to the bottom horizontal member of the wood frame;

inserting a non-wooden double hung window into the wood frame, the non-wooden double hung window comprising:

a top horizontal member having ends, each end of the top horizontal member attached to a vertical side member, a bottom horizontal member having ends, each end of the bottom horizontal member attached to the vertical side members so as to construct a substantially rectangular frame with an interior surface and an exterior surface, and an upper and lower metal window sash, wherein at least one of the non-wooden double hung window vertical members and non-wooden double hung window horizontal members are substantially hidden when viewed from an angle perpendicular to the face of the window;

fastening the non-wooden double hung window into the wood frame;

attaching the wood frame and non-wooden double hung window combination to the framework of the building.

4. A replacement window comprising:

a replacement wood frame which has a similar exterior appearance to the existing window, the wood frame comprising:

a top horizontal member having ends, each end of the top horizontal member attached to a vertical side member, a bottom horizontal member having ends, each end of the bottom horizontal member attached to the vertical side members so as to construct a substantially rectangular frame with an interior surface and an exterior surface, and a center horizontal member attached between the two vertical members approximately equidistant between the top and bottom horizontal members;

a plurality of weep holes drilled in the bottom of the wood frame, the weep holes drilled at an angle;

at least one groove routed in the center bar of the wood frame;

a stiffener with at least one protrusion matched to the at least one groove adhered to the center horizontal member;

at least one groove routed in the bottom horizontal member of the wood frame;

a weatherguard strip with at least one protrusion matched to the at least one groove adhered to the bottom horizontal member of the wood frame;

a non-wooden double hung window inserted into the wood frame, the non-wooden double hung window comprising:

a top horizontal member having ends, each end of the top horizontal member attached to a vertical side member, a bottom horizontal member having ends, each end of the bottom horizontal member attached to the vertical side members so as to construct a substantially rectangular frame with an interior surface and an exterior surface, and an upper and lower metal window sash, wherein at least one of the non-wooden double hung window vertical members and non-wooden double hung window horizontal members are substantially hidden when viewed from an angle perpendicular to the face of the window;

the non-wooden double hung window fastened into the wood frame;

the wood frame and non-wooden double hung window combination attached to the framework of the building.

* * * * *